US005600411A

United States Patent [19]

Hart

[11] Patent Number: 5,600,411

[45] Date of Patent: Feb. 4, 1997

[54] MULTI LAYER TONER FILTRATION TRAP

[75] Inventor: Steven C. Hart, Webster, N.Y.

[73] Assignee: Xerox Corporation, Stamford, Conn.

[21] Appl. No.: 474,861

[22] Filed: Jun. 7, 1995

[51] Int. Cl.[6] ..... G03G 21/00

[52] U.S. Cl. ..... 399/98; 209/315

[58] Field of Search ..... 355/298, 215, 355/245; 118/652; 209/315, 317

[56] References Cited

U.S. PATENT DOCUMENTS

| | | | |
|---|---|---|---|
| 4,054,381 | 10/1977 | Bernhard | 355/302 |
| 4,319,832 | 3/1982 | Sakamoto et al. | 355/303 |
| 4,360,944 | 11/1982 | Iwai et al. | 118/652 |
| 4,389,968 | 6/1983 | Satomura | 118/652 |
| 4,561,759 | 12/1985 | Knott | 355/245 |
| 4,752,805 | 6/1988 | Fukae et al. | 355/298 |
| 5,200,788 | 4/1993 | Thayer | 355/298 |
| 5,337,901 | 8/1994 | Skaer | 209/315 |
| 5,423,430 | 6/1995 | Zaffiro et al. | 209/315 |
| 5,502,549 | 3/1996 | Hart et al. | 355/245 |

*Primary Examiner*—Shuk Yin Lee
*Attorney, Agent, or Firm*—John S. Wagley

[57] ABSTRACT

An apparatus for trapping a contaminant is provided. The apparatus includes a first member having a plurality of apertures in the first member and a second member having a plurality of apertures in the second member. The second member is in juxtaposition with the first member. A space between the first member and the second member is smaller than a maximum length of the contaminant.

16 Claims, 5 Drawing Sheets

MULTI LAYER TONER FILTRATION TRAP

The present invention relates to a developer apparatus for electrophotographic printing. More specifically, the invention relates to a filter for filtering toner.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image.

In an electrophotographic printer as the developer material is transferred to the photoreceptor and eventually to the copy paper, this used toner must be replaced. The electrophotographic printer thus includes a device for replenishing toner from which fresh toner is dispensed into the machine. In earlier copy machines and printers, toner used in the developer unit was replenished by pouring loose toner into a toner container. In using this replenishing method at least two major problems occurred. The first problem was that a portion of the loose toner could either be spilled during filling or the loose toner would form a cloud when filling and settle later. In either case the spilled or settled toner could contaminate the machine or printer and require an expensive service call. The second problem was that contamination could enter the toner container during fill and negatively effect the operation of the machine.

In more recent copy machines and printers, toner used in the developer unit is replenished by exchanging an empty toner resupply cartridge with a new, full cartridge. Many devices have been used to seal the cartridge prior to installation in the machine. These devices and others have been used to maintain the sealed integrity of the copy cartridge during the exchange of an empty cartridge for a full cartridge. The use of cartridges has reduced the problems with spilled and settled toner as well as contamination problems during toner replenishing. To provide for a small compact toner cartridge and to provide for a toner cartridge in which the opening to the cartridge may be easily opened and closed or removed, the toner cartridge typically has a compact shape with a small opening from which the toner is dispensed. While the use of cartridges for the storage and refilling of toner within a machine reduces the contamination encountered during filling, even in the most stringently controlled manufacturing environments, contaminants may enter the toner itself during its manufacture and/or could enter the cartridge during filling at the factory and later progress into the developer housing causing copy quality problems.

The development system, the area of the electrophotographic printer where the developer material is transferred to the photoreceptor, typically includes a wide area extending across the full width of the photoreceptor in order that a full image width may be developed. The toner must thus progress from the toner container into the developer housing and progress along the full width of the developer housing in order that the full width of the latent image may be developed. Furthermore, in attempts to make inexpensive and compact electrophotographic printers and to minimize space and related costs, the location of the toner cartridge and the developer housing may be far apart.

If the contamination, particularly in the form of clothing and paper fibers, reaches the developer housing, copy quality and machine reliability suffer. Toner particles also have a tendency to adhere together into large scale clumps which ride on the top of the developer material in the developer housing negatively effecting the blending and admixing of the incoming toner.

The use of smaller carrier and toner particles, which are typical when using colored toners for color electrophotography compounds problems associated with contamination. Imperfections in color copies, such as those caused by contamination, are much more noticeable to the human eye than imperfections in monochromic copies.

The presence of contamination in development systems utilizing hybrid scavengeless development is particularly a concern. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al. U.S. Pat. No. 4,868,600 is incorporated herein by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography. The small color toner and related carrier particles used for the implementation of these devices and the greater visual scrutiny given to color copies compound contamination problems. Furthermore, the electrode wires utilized to form the toner powder cloud are particularly susceptible to contamination in general and in particular, to long slender fibers such as clothing and paper fibers.

Filters have been used to trap these fibers, but long slender fibers are particularly difficult to remove. Screens with large apertures permit the passage of fibers as well as toner,while filters with small apertures either prohibit the passage of fibers and toner or greatly inhibit the flow of toner therethrough.

The following disclosures may be relevant to various aspects of the present invention:

U.S Pat. No. 5,200,788
Patentee: Thayer
Issue Date: Apr. 16, 1993

U.S. Pat. No. 4,752,805
Patentee: Fukae et al.
Issue Date: Jun. 21, 1988

U.S. Pat. No. 4,561,759
Patentee: Knott
Issue Date: Dec. 31, 1985

U.S. Pat. No. 4,389,968
Patentee: Satomura
Issue Date: Jun. 28, 1983

U.S. Pat. No. 4,360,944
Patentee: Iwai et al.
Issue Date: Nov. 30, 1982

U.S. Pat. No. 4,319,832
Patentee: Sakamoto et al.
Issue Date: Mar. 16, 1982

U.S. Pat. No. 4,054,381
Patentee: Bernhard
Issue Date: Oct. 18, 1977

U.S. Pat. No. 5,502,549
Applicant: Hart et al.
Issue Date: Mar. 26, 1996

U.S. patent application Ser. No. 08/321,632
Applicant: Hart et al.
Filing Date: Oct. 11, 1994

The relevant portions of the foregoing disclosures may be briefly summarized as follows:

U.S. Pat. No. 5,200,788 discloses a brush auger reclaim filtration assembly incorporated into an open ended chamber. The brush auger is a toner reclaim filtration device that is rotatably mounted, in the chamber, to move toner and debris along a separating screen. Also contained in the housing is a mounted transport auger that rotates as it moves the reclaimed toner to the development housing.

U.S. Pat. No. 4,752,805 discloses a device for recycling residual developer particles which are removed from a photoconductive element by a cleaning unit in an electrographic copier or printer. The device comprises a first tube connected to the cleaning unit and a second tube which is connected to the first tube and leads to the developer unit. The second tube is disposed along the developer unit. The residual particles are transferred from the cleaning device through the first tube and into the second tube. The second tube is provided with holes spaced at predetermined distances from each other. The residual particles fall through those holes and co-mingle with developer material stored in the developer unit. A second auger is disposed within the second tube to move the residual particles to the first tube.

U.S. Pat. No. 4,561,759 discloses a device for filling and filtering toner from a supply container which is placed by an operator in communication with a feed container in a photocopier. The device has a cylindrical filling opening for the feed container with a cross section such that the supply container can be inverted. The device has a filter basket disposed in the region of the filling opening which is closed from the feed container by a filter mesh. An electric vibrator is connected to the device.

U.S. Pat. No. 4,389,968 discloses a toner regenerating device with a mesh disposed in the route of the toner collected from an image bearing member. The device includes an apparatus for imparting to the collected toner through the mesh a force causing the collected toner to move along the mesh. The collected toner on the mesh containing foreign material and solidified toner is loosened so that the solidified toner is divided into fine particles. The foreign matter is caused to float up over the collected toner and prevented from passing through the mesh.

U.S. Pat. No. 4,389,968 discloses a toner transporting device for an electrophotographic copying apparatus. The device includes a transporter for carrying toner to and into a chamber through a first opening. Toner in the chamber is moved out of a second opening. An elastic plate is mounted at one of its ends for rotation within the chamber such that its opposite tip end is maintained in contact with the interior wall of the chamber except at the second chamber opening.

U.S. Pat. No. 4,319,832 discloses a cylindrical electrode disposed in a tubular housing and applied with an electric potential opposite in polarity to a charge on usable toner particles removed from the photoconductive drum. A fur brush functions to remove the toner and foreign matter from the drum and to create an air flow which carries the toner and foreign matter through a passageway defined between the housing and cylinder. The foreign matter is carried into a foreign matter chamber by centrifugal force while the toner adheres to the cylinder which is rotated in the same direction as the air flow. The toner is carried past a blade which extends closely adjacent to the cylinder into a toner recovery chamber from which it is scrapingly removed from the cylinder and recycled.

U.S. Pat. No. 4,054,381 discloses a toner filter arrangement adapted for use in a cleaning station of a xerographic reproduction machine. Foreign material and other contaminants are removed from residual toner prior to its collection in a disposable or reuse container or return to the developer station. The filter arrangement comprises a housing having an input opening through which removed toner enters and an output opening through which filtered toner exits. The housing includes a spiral brush mounted for rotation on a shaft centrally located within the housing and a stationary open mesh screen coaxially located with respect to the shaft. Rotation of the brush operates to sift toner through the screen to the outlet of the filter housing.

U.S. Pat. No. 5,502,549 discloses a printing machine of the type having a developer unit adapted to develop with marking particles a latent image. The machine includes a conduit and a mover for moving the marking particles in the conduit. The machine further includes a screen positioned adjacent the conduit so that the marking particles pass therethrough and an applicator for applying an electrical bias between the mover and the screen to facilitate the passage of marking particles therethrough.

U.S. patent application Ser. No. 08/321,632 discloses a printing machine of the type having a developer unit adapted to develop with marking particles a latent image. The machine includes a conduit and a mover for moving the marking particles within the conduit. The machine also includes a screen positioned adjacent the conduit so that substantially all the marking particles discharged from the conduit pass through the screen.

SUMMARY OF THE INVENTION

According to the present invention, there is provided an apparatus for trapping a contaminant. The apparatus includes a first member having a plurality of apertures in the first member and a second member having a plurality of apertures in the second member. The second member is in juxtaposition with the first member. A space between the first member and the second member is smaller than a maximum length of the contaminant, and larger than the particle size of the material to be filtered.

According to the present invention there is further provided a printing machine of the type having a developer unit adapted to develop a latent image with marking particles. The machine includes a conduit having marking particles and contaminants moving through the conduit. The machine further includes a first member which defines a plurality of apertures in the first member. The first member is positioned at least partially in the conduit. The machine further includes a second member which defines plurality of apertures in the second member. The second member is positioned in juxtaposition with the first member and defines a space between the members smaller than a maximum length of the contaminants.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 5 printing machine will be shown hereinafter schematically and their operation described briefly with reference thereto.

Figure 5:
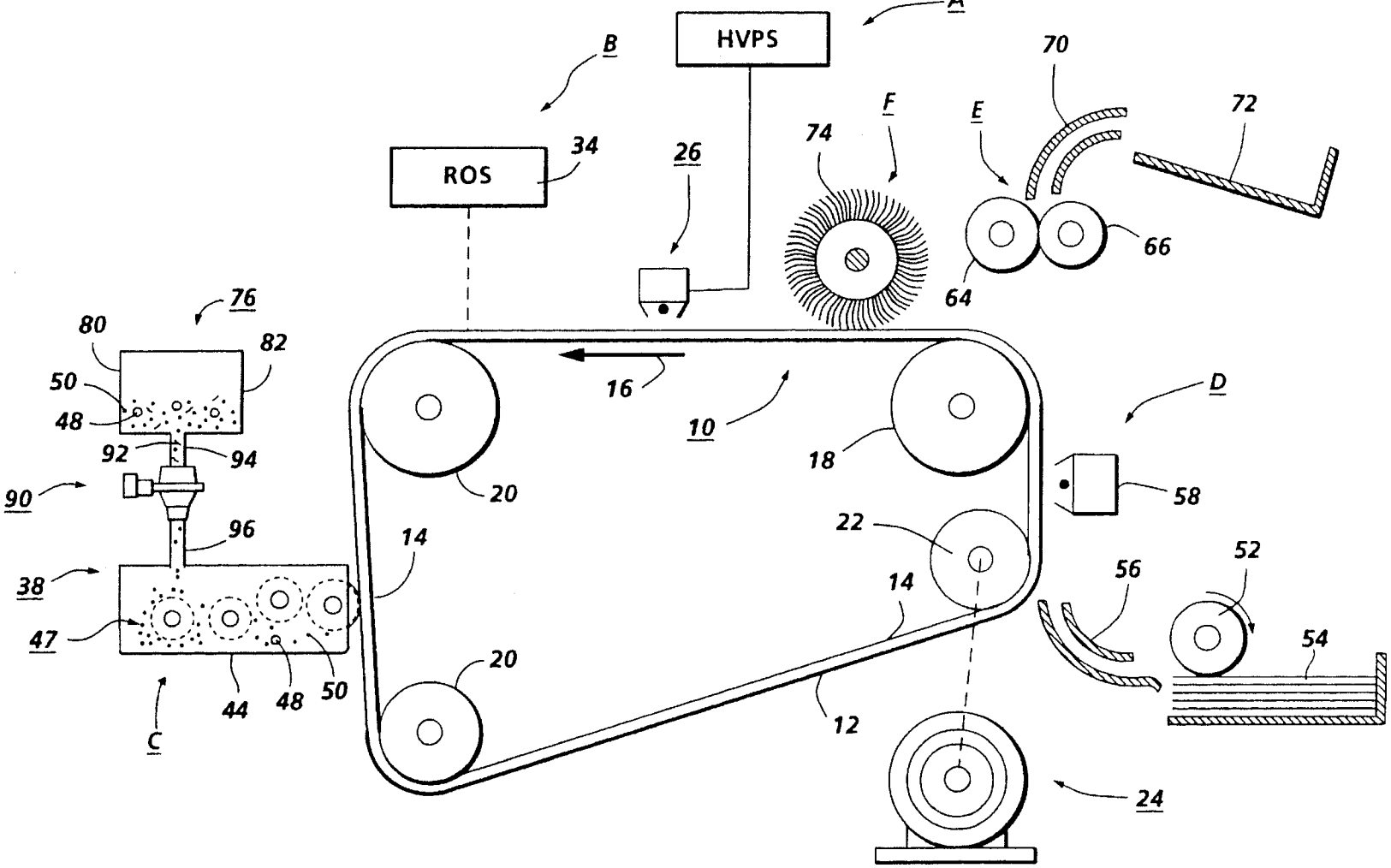
FIG. 5 is a schematic elevational view of an illustrative electrophotographic printing machine incorporating the multi layer screen filter of the development apparatus of the present invention therein.

Referring initially to FIG. 5, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably, the surface 12 is made from a selenium alloy or a suitable photosensitive organic compound. The substrate 14 is preferably made from a polyester film such as Mylar® (a trademark of Dupont (UK) Ltd.) which has been coated with a thin layer of aluminum alloy which is electrically grounded. The belt is driven by means of motor 24 along a path defined by rollers 18, 20 and 22, the direction of movement being counterclockwise as viewed and as shown by arrow 16. Initially a portion of the belt 10 passes through a charge station A at which a corona generator 26 charges surface 12 to a relatively high, substantially uniform, electrical potential. A high voltage power supply 28 is coupled to device 26.

Next, the charged portion of photoconductive surface 12 is advanced through exposure station B. At exposure station B, the ROS 34 lays out the image in a series of horizontal scan lines with each line having a specified number of pixels per inch. The ROS includes a laser and a rotating polygon mirror block associated therewith. The ROS exposes the charged photoconductive surface of the printer.

After the electrostatic latent image has been recorded on photoconductive surface 12, the motion of the belt 10 advances the latent image to development station C as shown in FIG. 5. At development station C, a development system 38, develops the latent image recorded on the photoconductive surface. The chamber in developer housing 44 stores a supply of developer material 47. The developer material 47 may be, as shown in FIG. 5, a two component developer material of at least magnetic carrier granules 48 having toner particles 50 adhering triboelectrically thereto. It should be appreciated that the developer material may likewise comprise a one component developer material consisting primarily of toner particles.

Again referring to FIG. 5, after the electrostatic latent image has been developed, the motion of the belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 8, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual developer material adhering to photoconductive surface 12 is removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Referring again to FIG. 5, in order to provide a constant supply of at least toner 50 to replace that consumed in the developing of the latent image, the development system 38 includes a cartridge 80 for storing a replaceable supply of replenisher 76 including at least toner 50. The replenisher 76 may contain carrier granules 48 as well as toner particles 50 in order to replace worn and broken carrier granules 48 as shown in FIG. 5. It should be appreciated however that the invention may be practiced with the replenisher including only toner. As the typical usage of toner is larger than the typical usage of carrier granules (on a weight basis) whether on a per copy or per hour basis, the ratio of toner to carrier in the cartridge is much larger than the ratio of toner to carrier in the housing. The use of replenisher containing carrier particles as well as toner is disclosed in U.S. Pat. No. 4,614,165 to Folkins et al. herein incorporated by reference. The cartridge 80 is a replaceable item that can be made of any suitable durable material. It may be vertically oriented with its opening pointed downward whereby it may be emptied by gravity. Where, however, space constraints become a problem, the cartridge 80 may include a device (not shown) for extracting the developer material from the cartridge 80. Particles in the toner cartridge 80 progress to a toner sump or developer sump 82 as shown in FIG. 5. While the sump 82 may ideally be located above the development housing 44 whereby gravity may feed the replenisher 76 from the sump 82, where, as earlier stated, space constraints for the toner cartridge 80, sump 82, and developer housing 44 become a concern, the sump 82 may not be located above the development housing 44.

Referring again to FIG. 5, according to the present invention, an apparatus 90 for filtering contaminants is shown as part of development system 38. It should be appreciated that the use of apparatus or filter 90 is adaptable to development systems utilizing primarily toner or toner and carrier (developer). The development system 38 as shown in FIG. 5 represents a typical development system providing toner from toner cartridge 80 to the photoreceptor belt 10.

It should also be appreciated that the copy machine may also include a cleaning system (not shown) as part of the cleaning station F in which toner not used in the development process may be recycled for use in the developer system 38. It should be appreciated that the toner supplied by the cleaning system may alternatively or in addition to be filtered by the multi layer filter 90. It should further be appreciated that in the manufacture of toner particles contamination which may include fibers may need be filtered from the manufactured toner and that the multi layered toner filter 90 may be adapted to the manufacture of toner.

Referring again to FIG. 5, the development system 38 includes the developer housing 44 which supports the remainder of the developer system 38. The cartridge 80 may be interconnected in any suitable fashion to the developer housing 44. Preferably, where space is available, the cartridge 80 is located above the developer housing 44 to take advantage of the effects of gravity. Also, the cartridge 80 may preferably be at a location near the periphery of the copy machine to facilitate the replacement of the cartridge 80. Although preferably the replenisher 76 is moved from the cartridge 80 to the developer housing 44 solely by means of gravity, when required, a toner mover in the form perhaps of an auger 92 is located in an inlet conduit or supply pipe 94 between the cartridge 80 and the apparatus 90. An outlet conduit 96 interconnects the apparatus 90 to the developer housing 44. The replenisher 76 thus travels from the cartridge 80 through the inlet conduit 94, through the apparatus 90, out the outlet conduit 96 and finally into developer housing 44.

Figure 1:
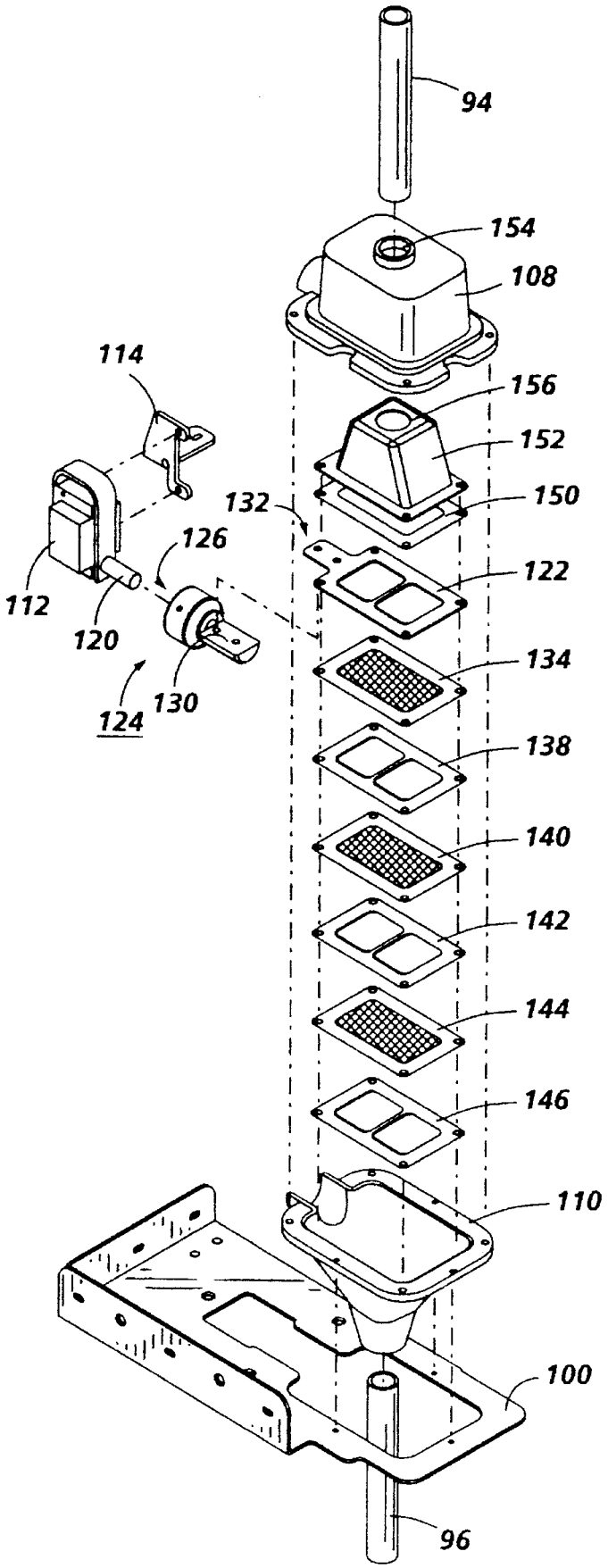
FIG. 1 is a perspective view of a multi layer screen filter according to the present invention.

Referring now to FIG. 1, the apparatus 90 is shown in greater detail. The apparatus 90 includes mounting bracket 100 which is connected to copier frame 102 by any suitable means. For example, the mounting bracket may be connected to the frame 102 by fasteners in the form of screws 104 which fit through openings 106 of the mounting brackets 100 and are threadedly secured to the copier frame 102. A filter housing assembly 107 is secured to mounting bracket 100 in any suitable fashion such as by fasteners or adhesives. The filter housing assembly 107 is composed of an upper filter housing body 108 and a lower filter housing body 110. Inside the filter housing assembly 107 is-a filter screen assembly 111 which is connected to a vibration driving device 112.

The vibration driving device 112 preferably is in the form of a mechanical vibrator. The mechanical vibrator 112 may be any suitable vibrator such as those commercially available. The vibrator 112 induces vibration into the filter screen assembly 111.

Figure 2:
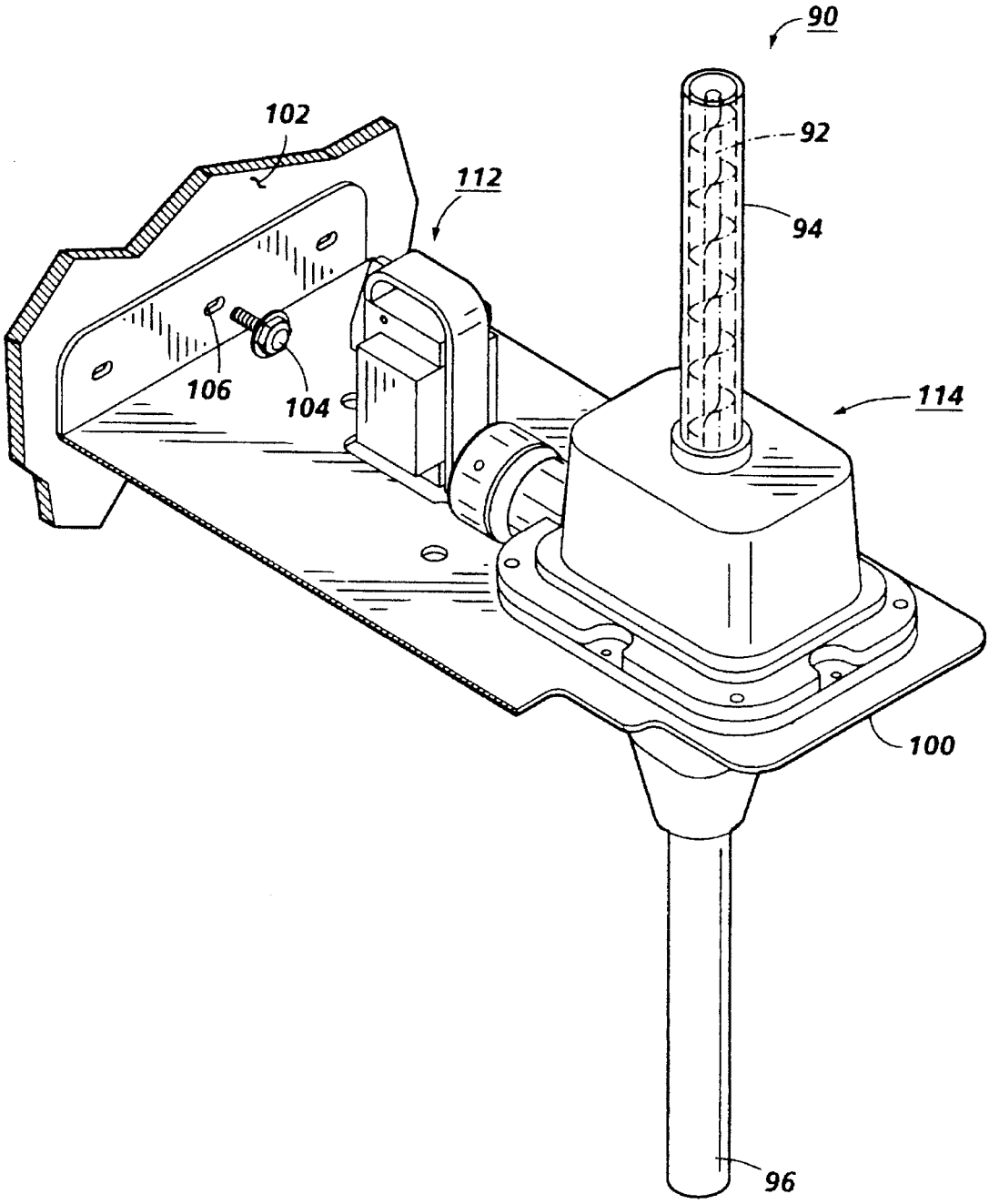
FIG. 2 is an exploded perspective view of the filter of FIG. 1.

Now referring to FIG. 2, the apparatus 90 is shown with the components of the apparatus separated in an exploded view. The mechanical vibrator 112 is secured by vibrator mounting bracket assembly 114 to the mounting bracket 100 (see FIG. 1). It is desirable that the vibrator mounting bracket assembly 114 include some means for isolating the mechanical vibration of the vibration driver 112 and the filter screen assembly 111 from the mounting bracket 100. Thus, while the mounting bracket is illustrated as a single piece, in practice it will most likely be a combination of materials suitable to provide both the mounting and vibration isolation functions. The vibrator mounting bracket assembly 114 may be made of any combination of suitable durable material such as steel stampings or plastics.

Extending from mechanical vibrator 112 is a mounting stem 120. The vibrator 112 and the stem 120 vibrate when the vibrator 112 is engaged. Mounting stem 120 is connected to an upper screen mounting plate 122 by any suitable means such as adaptor 124. The upper screen mounting plate 122 and the adaptor 124 are made of any suitable durable rigid material such as plastic or a metal. The adaptor 124 includes an opening 126 to which stem 120 matingly fits and a flat surface 130 to which protruding tab 132 of the upper screen mounting plate 122 matingly fits.

A first filter screen plate 134 is placed below the upper screen mounting plate 122. The filter screen plate 134 is made of a thin durable material with numerous small openings 136.

This screen 134 may be fabricated from a thin metal foil or plastic film with the openings formed by any suitable means such as chemical etching, laser machining, or punching. Alternatively, this screen may be fabricated from a woven plastic or metal wire mesh. Yet another method for formation of this screen is the process of electrodeposition of metals.

Placed below the first filter screen plate 134 is a screen spacer 138. The spacer 138 may be made of any suitable material but preferably is made of a non compressible material. The screen spacer 138 may be made of any suitable durable material such as metal or plastic.

A second filter screen plate 140 is placed below the first screen spacer 138. A second screen spacer 142 is placed below the second filter screen plate 140. While this invention may be practiced with only two screens, the apparatus 90 preferably includes a third filter screen plate 144 which is placed below the second screen spacer 142.

A lower screen mounting plate 146 is next located below the third filter screen plate 144. The lower screen mounting plate 146 is made of any suitable durable rigid material such as plastic or a metal.

Located on top of the upper screen mounting plate 122 are a gasket 150 and a replenisher containment housing 152. The gasket 150 can be fabricated from any suitable material such as a foam rubber. The replenisher containment housing 152 is typically fabricated from a plastic material.

When the apparatus is assembled, the toner inlet conduit supply pipe 94 passes through and is sealed to an opening 154 in the upper filter housing body 108. The toner inlet conduit supply pipe 94 passes through an opening 156 in the replenisher containment housing 152 without touching the housing 152. There can optionally be a thin elastomeric diaphragm seal (not shown) between the toner inlet supply pipe 94 and the replenisher containment housing 152. If such a diaphragm seal is implemented, it should be designed so as not to impede the vibration of the filter screen assembly 111.

Additionally there is a tubular membrane seal (not shown) between the filter housing assembly 107 and the adapter 124.

Figure 3:
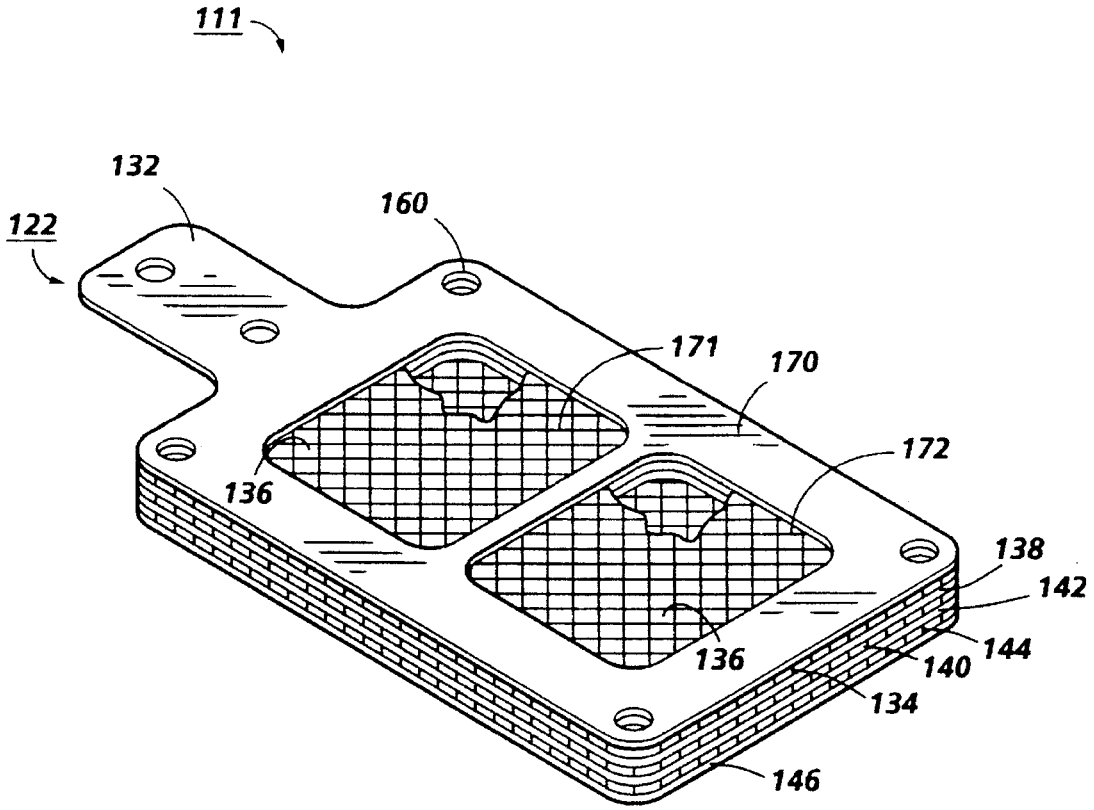
FIG. 3 is a perspective view of the the plates and spacers of the filter of FIG. 1.

Now referring to FIG. 3, the filter screen assembly 111 is shown in greater detail. The filter screen assembly 111 includes the filter screen plates-134, 140, and 144 and the screen spacers 138 and 142. The filter screen assembly 111 also includes the upper screen mounting plate 122 and the lower screen mounting plate 146. The filter screen assembly 111 further includes the gasket 150 and the replenisher containment housing 152. It should be appreciated that all components of the filter screen assembly 111 should be mechanically locked together. This can be done by any suitable means such as a mechanical fastener located through holes 160 in the plates and spacers.

Preferably only a minimal mass should be vibrated. This is done to minimize the required strength of the mechanical vibrator 112 (see FIG. 2) and to minimize the vibration induced into the rest of the copy machine. Thus it is desirable to minimize the thickness of the mounting plates 122 and 146, solid or plate area 170 the screen plates, and the wall thickness of the replenisher containment housing 152.

The screen plate 134 includes the solid or plate area 170 and at least one screen area 171. The filter screen assembly 111 as shown in FIG. 3, includes also a second screen area 172 similar to first screen area 171. The size and quantity of screen areas is determined by the amount of toner which must flow through the filter 111. The screen areas 171 and 172 include a plurality of openings or apertures 136. A sufficient number of apertures 136 exist to provide for approximately 20 to 50 percent of the screen area 171 and 172 to be open. The filter 111 as shown in FIG. 3 includes a sandwich of filter screen plates 134, 140, 144, . . . and screen spacers 138, 142, . . . with one spacer being placed between adjacent screen plates. As shown in FIG. 3, four screen plates are separated by three spacers. The upper screen mounting plates 122 includes -openings 174 to which fasteners (not shown) are used to interconnect the tab 132 of the upper screen mounting plate 122 with the adaptor 124 (see FIG. 2). While the screen plates and spacers as shown in FIG. 3 have a generally planar shape, to simplify manufacturing and to minimize their mass, it should be appreciated that the invention can be practiced with screen plates of different shapes such as arcuate discs or rings or any other suitable shape with which layers of screens may be separated by spacers.

Figure 4:
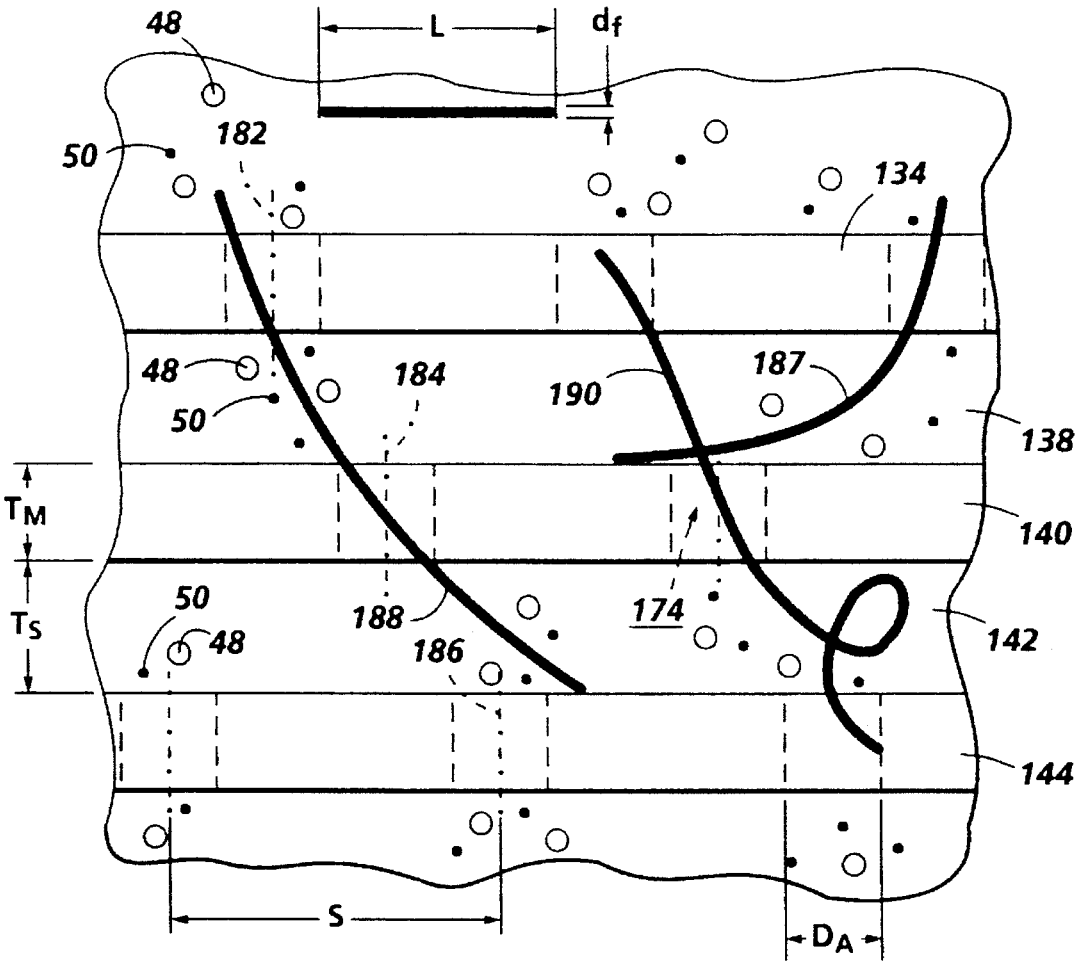
FIG. 4 is a partial sectional view of the the plates and spacers of the filter of FIG. 1 showing the position of the apertures.

Referring now to FIG. 4, the apertures of adjoining screen plates are shown in greater detail. The first plate 134 is separated from the second plate 140 by spacer-138 and the second plate 140 is separated from the third plate 144 by spacer 142. The first second and third plates 134, 140 and 144 preferably have a generally uniform thickness $T_m$ of approximately 50 microns. In order to trap contaminants with a length greater than 1000 microns, the spacers 138 and 142 have a generally uniform thickness $T_s$ less than the length of the contaminant, for example of approximately 250 microns.

The apertures 136 of the screen plates 134 and 140 have a diameter $D_a$ of approximately 325 microns with a acceptable range for the filtering of toner of from about 200 microns to 750 microns. Centerlines 182 of the apertures 136 of the first screen plate 134 are preferably non-coincident with centerlines 184 of the apertures 136 of the second screen plate 140. Centerlines 184 of the second screen plate 140 are preferably non-coincident with centerline 186 of the third screen plate 144. Either by design or fabrication or both the apertures in the multiple filter screen plates do not line up in a straight line. Adjoining apertures 136 have a distances between their respective centerlines of approximately 0.025 inches.

In the operation of the apparatus 90, one end of a fibrous contaminant, for example in the form of a fiber 187, 188, or 190, to be filtered from the replenisher 76 enters an aperture 136 in the first screen plate-134. Since the diameter $d_f$ of the fiber 187, 188 or 190 is smaller than the diameter $D_a$ of the aperture, the fiber passes through the aperture 136 of the first screen plate 134. At this point the end of the fiber will either encounter the structure of the second filter screen plate 140 or it will encounter an aperture in the second filter screen plate.

For example the fiber 187 encounters the structure of the second filter screen plate 140 and can continue to progress into the space between the first and the second filter screen plates, 134 and 140, respectively. The fiber 187, has a length l greater than the distance between the plates 134 and 140 formed by spacers 138 and 142 having a thickness $T_s$, the fiber 187 can not reorient itself in a favorable attitude so as to enter an opening in the second screen plate 140. The fiber 187 is thus trapped between the first and second screen plates 134 and 140 and may not travel further.

For example the leading end of the fibers 188 and 190 encounter an aperture 136 in the second filter screen plate 140. The fiber 188 will continue to progress into the space between the filter screen plates 140 and 144. Here again the fiber can encounter the structure of the third filter screen plate 144 or it can encounter an aperture 136 in the third filter screen plate.

For example the fiber 188 encounters the structure of the third filter screen plate 144, the fiber can, in a fashion similar to that described above, proceed into the region between the second and third filter screen plates 140 and 144. Here because of the inability of the fiber 188 to reorient itself, the fiber 188 will become trapped.

For example the fiber 190 encounters the aperture 136 in the third filter screen plate 144. The fiber 190 will also most likely become mechanically trapped if it is sufficiently long. Since, by design/fabrication the apertures in the multiple filter screen plates do not line up in a straight line, only curved fibers will be able to enter an aperture in the third filter screen plate 144. Thus, only longer fibers with a smooth and constant curvature will be able to progress simultaneously through the apertures 136 in the three filter screen plates 134, 140, and 144. If the fiber is sufficiently long and does not have a uniform curvature, at some point during passage through the apertures, the fiber will become mechanically bound by the plurality of screens.

The replenisher 76 to be filtered includes, on the other hand, toner particles 50 having a size of approximately 7 microns as well as carrier granules 48 having a particle size of approximately 50 microns which are much smaller than the aperture diameter $D_a$. Also, the carrier granules 48 and toner 50 particles are significantly smaller that the spacing between the filter screen plates. This spacing is determined by the thickness of the filter screen spacers. Thus, the carrier granules 48 and toner 50 particles move freely through apertures 136 in both the first screen plate 134 and the second screen plate 140. The filter 160 thereby traps fibers 187, 188, and 190 while permitting toner 50 and carrier particles 48 to freely flow therethrough. Applicant has found that while the invention may be practiced with as few as two screen plates 134 and 140, filtering efficiency increases if three or more plates are utilized.

Referring again to FIG. 1, the mechanical vibrator 112 preferably has a frequency from 30 to 120 Hz. Applicant has found that the amplitude of vibration of the mechanical vibrator 112 is important and needs to be tuned with the characteristics of the replenishers 76.

The use of a screen type filter including a plurality of filters serves to trap filter fibers between adjacent screens permitting the free flow of carrier granules and toner particles while trapping fibers.

The use of a vibrator secured to a plurality of spaced apart screens permits the free flow of carrier granules and toner particles while trapping fibers within the several screens and in the spaces therebetween.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An apparatus for trapping a contaminant, comprising:

a first member defining a plurality of apertures therein; and a second member defining a plurality of apertures therein, said second member in juxtaposition with said first member and defining a space therebetween smaller than a maximum length of the contaminant.

2. An apparatus according to claim 1, further comprising means for inducing vibrations into at least one of said first member and said second member.

3. An apparatus according to claim 1, wherein said first member comprises a screen.

4. An apparatus according to claim 1, wherein at least one of said first member and said second member comprise a plate.

5. An apparatus according to claim 1, wherein said first member and said second member are substantially parallel to each other.

6. An apparatus according to claim 1, wherein:

said first member defines a plurality of randomly distributed apertures; and said second member defines a plurality of randomly distributed apertures.

7. An apparatus according to claim 1, wherein at least a portion of the apertures in said first member are offset from the apertures in said second member.

8. An apparatus according to claim 2, wherein said inducing means comprises a mechanical vibrator.

9. A printing machine for developing with a supply of particles a latent image, said printing machine including a devloper unit comprising:

a conducit having marking particles and contaminants moving therethrough;

a first member defining a plurality of apertures therein, said first member positioned at least partially in said conduit; and a second member defining a plurality of apertures therein, said second member positioned in juxtaposition with said first member and defining a space therebetween smaller than a maximum length of the contaminants.

10. A printing machine according to claim 9, further comprising means for inducing vibration into at least one of said first member and said second member.

11. A printing machine according to claim 9, wherein said first member comprises a screen.

12. A printing machine according to claim 9, wherein at least one of said first member and said second member comprise a plate.

13. A printing machine according to claim 9, wherein said first member and said second member are substantially parallel to each other.

14. A printing machine according to claim 9, wherein:

said first member defines a plurality of randomly distributed apertures; and said second member defines a plurality of randomly distributed apertures.

15. A printing machine according to claim 9, wherein at least a portion of the apertures in said first member are offset from the apertures in said second member.

16. A printing machine according to claim 10, wherein said inducing means comprises a mechanical vibrator.

* * * * *